US011744309B2

(12) United States Patent
Davis

(10) Patent No.: US 11,744,309 B2
(45) Date of Patent: Sep. 5, 2023

(54) ILLUMINATED HARD HAT

(71) Applicant: Buck L Davis, North Fork, CA (US)

(72) Inventor: Buck L Davis, North Fork, CA (US)

( * ) Notice: Subject to any disclaimer, the term of this patent is extended or adjusted under 35 U.S.C. 154(b) by 0 days.

(21) Appl. No.: 16/870,635

(22) Filed: May 8, 2020

(65) Prior Publication Data

US 2021/0345719 A1 Nov. 11, 2021

(51) Int. Cl.
*A42B 3/04* (2006.01)

(52) U.S. Cl.
CPC ..... *A42B 3/044* (2013.01)

(58) Field of Classification Search
CPC ..... A42B 3/044
See application file for complete search history.

(56) References Cited

U.S. PATENT DOCUMENTS 4,516,192 A 5/1985 Bolwig
5,327,587 A 7/1994 Hurwitz
5,564,128 A 10/1996 Richardson
5,810,467 A 9/1998 Hurwitz
5,871,271 A 2/1999 Chien
6,499,145 B1 12/2002 Kates
7,121,676 B1 10/2006 Kutnyak
7,950,074 B2 5/2011 Loizzo
8,192,043 B2 6/2012 Lombard
10,514,161 B2 12/2019 Lombard
2016/0360817 A1* 12/2016 Lombard ..... F21V 33/0008
2018/0325202 A1* 11/2018 McAllister ..... A42B 3/125

* cited by examiner

*Primary Examiner* — Thomas M Sember

(57) ABSTRACT

An exemplary illuminated hard hat for providing visibility to workers is presented. The illuminated hard hat allows for the Illumination of the hard hat. Since, the illumination come from inside of the hard hat there no distracting lights to the face. The illuminated hard hat is lightweight and cost effective. The illuminated hard hat further protects workers from injury while meeting OSHA requirements required by law. The illuminated hard hat is useful for construction workers, road workers, mountain climbers as well as anyone who desires to wear a hard hat. While the illuminated hard hat is intended for hard hats, it can also be adapted to be used in any kind of hat worn by people.

11 Claims, 1 Drawing Sheet

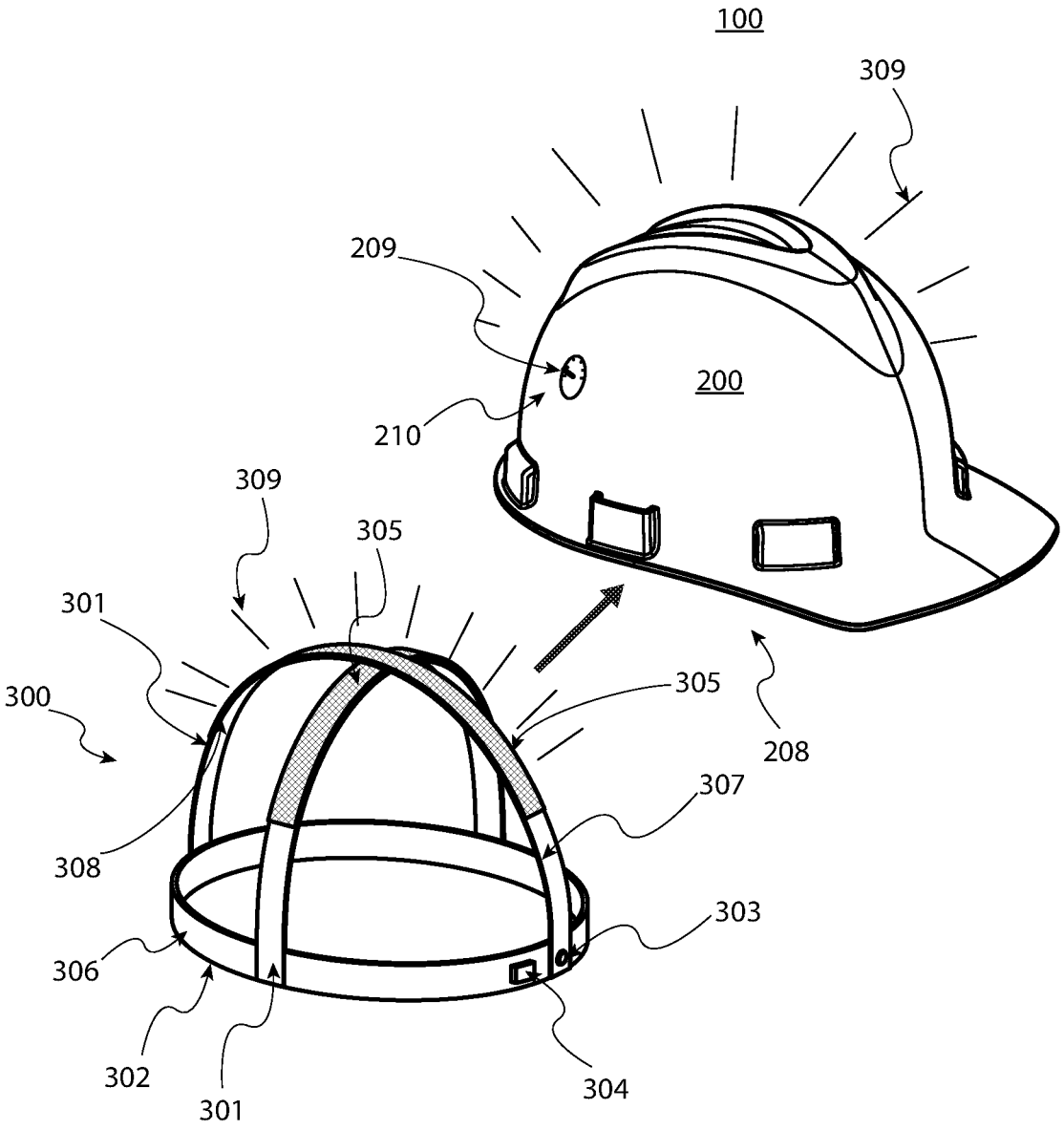
100
309
209
200
210
309
305
301
300
305
208
307
308
303
306
302
301
304

ILLUMINATED HARD HAT

FIELD OF THE INVENTION

This invention relates to hard hats. More particularly, it relates to illuminating a hard hat.

BACKGROUND

Satellite communication devices are gaining increased use in many application areas. Such devices are now being used in over-the-highway truck fleets to allow greater communication between the truck driver and a fleet base operator. The devices generally allow data related to the truck performance and characteristics to be communicated on demand, or at automatically timed periodic intervals.

A hard hat is a type of helmet predominantly used in workplace environments such as industrial or construction sites to protect the head from injury due to falling objects, impact with other objects, debris, rain, and electric shock. Suspension bands inside the helmet spread the helmet's weight and the force of any impact over the top of the head. A suspension also provides space of approximately 30 mm (1.2 inches) between the helmet's shell and the wearer's head, so that if an object strikes the shell, the impact is less likely to be transmitted directly to the skull. Some helmet shells have a mid-line reinforcement ridge to improve impact resistance.

All too often we read in a newspaper, or see on television, the tragic aftermath of an accident that occurs at a road construction site. Many times, the driver of a vehicle collides with a piece of equipment or barricade and is only slightly injured, but traffic is backed up for hours.

However, there are those accidents in which a construction worker is hit and perhaps killed which are the most heartbreaking. While the reasons and causes are many, one common factor in almost all cases is that the driver did not see the worker due to low light, inclement weather and the like. While flashing barricades and work lights helps somewhat, they cannot provide complete coverage as the worker walks around.

Accordingly, there exists a need for a means by which roadside construction workers can be afforded increased visibility during night time hours or other periods of low visibility thus increasing their overall safety.

BRIEF DESCRIPTION OF THE DRAWINGS

FIG. 1 is an illustrated view of an exemplary illuminated hard hat.

DETAILED DESCRIPTION

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIG. 1, an illustrated view of an exemplary illuminated hard hat 100 for providing visibility to workers is presented. The illuminated hard hat 100 allows for the Illumination of the hard hat. Since, the illumination come from inside of the hard hat there are no distracting lights to the face. The illuminated hard hat 100 is lightweight and cost effective. The illuminated hard hat 100 further protects workers from injury while meeting OSHA requirements required by law. The illuminated hard hat 100 is useful for construction workers, road workers, mountain climbers as well as anyone who desires to wear a hard hat. While the illuminated hard hat 100 is intended for hard hats, it can also be adapted to be used in any kind of hat worn by people.

The illuminated hard hat 100 has a hard hat 200 and a suspension band 300. The hard hat 200 can be any type of hat, including, but not limited to, a hard hat, a baseball hat, a bicycle safety helmet, a climber safety helmet, etc. The hard hat 200 is preferably a construction worker's hard hat.

The suspension band 300 has a plurality of straps 301 and a plurality of light strips 305. The plurality of straps 301 are coupled to a base band 302. The base band 302 has an outside 306. The straps 301 have an outside 307. The outside 306 of the base band 302 has a switch 303 and a power source 304. The switch 303 is preferably a push button switch, however other types of switches are hereby contemplated, including, but not limited to, a toggle switch, a float switch, etc.

The switch 303 is electrically coupled to the power source 304. The power source 304 is preferably a rechargeable battery, however other types of power sources are hereby contemplated, including, but not limited to, disposable battery, solar charged battery, watch battery, etc.

The plurality of light strips 305 are removably coupled to the outside of the straps 301 by a fastener 308. The fastener 308 is preferably a hook and loop fastener, such as a Velcro® fastener, however other types of fasteners are hereby contemplated, including, but not limited to, two-sided tape, tie straps, etc. The lighting strips 305 are electrically coupled to the switch 303.

The light strips 305 have one or more lights. The number of lights on the light strip 305 is preferably three (3), however other numbers of lights are hereby contemplated, including, but not limited to, two (2), four (4), etc. The light strips 305 preferably are light emitting diode lamps, however other types of lights are hereby contemplated, including, but not limited to, button lights, liquid crystal display (LCD) lamps, etc.

Optionally and/or additionally, an adjusting control 209 is coupled to the hard hat 200 preferably at a back 210 of the hard hat 200. The adjusting control 209 is useful for adjusting the illumination 309 of the lighting strips 305. The adjusting control 209 is electrically coupled to the switch 303 and the lighting strips 305. Thus, being between the electrical coupling of the switch 303 to the lighting strips 305. The adjusting control 209 preferably being a dial control.

The suspension band 300 is coupled to an interior 208 of the hard hat 200. The suspension band 300 provides a tight fit to a head and a protective spacing between the head and the hard hat 200.

When the switch 303 is depressed, power from the power source 304 is directed to the lighting strips 305 and thus actuated emitting an illumination 309. When the suspension band 300 is coupled to the interior of the hard hat 200, the illumination 309 is extended through the hard hat 200. Thus, the hard hat 200 is illuminated such that the worker is further visible and can be seen by others. When the switch 303 is depressed again, the power from the power source 304 is restricted from being sent to the lighting strips 305 and thus preventing the illumination 309 from the lighting strips.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An illuminated hard hat for providing visibility to workers, the illuminated hard hat consisting of:

a hard hat, the hard hat having a back, an interior and an adjusting control;

a suspension band, the suspension band comprising:

a base band, the base band having an outside;

a plurality of straps, the plurality of straps having an outside, wherein the straps being coupled to the base band;

a plurality of lighting strips, each of the lighting strips being removably coupled to the outside of one of the straps by a fastener, wherein the fastener being a hook and loop fastening device;

a power source, the power source being coupled to the outside of the base band;

a switch, the switch being electrically coupled to the outside of the base band; and the adjusting control, the adjusting control being coupled to the back of the hard hat, wherein the adjusting control being electrically coupled to the switch, and wherein the adjusting control being electrically coupled to the lighting strips, and wherein the suspension band being coupled to the interior of the hard hat, and wherein the hard hat complies with OSHA requirements.

2. The illuminated hard hat of claim 1, wherein the adjusting control being a dial control.

3. The illuminated hard hat of claim 1, wherein the switch being a push button switch.

4. The illuminated hard hat of claim 1, wherein the power source being a rechargeable battery.

5. The illuminated hard hat of claim 1, wherein the hook and loop fastening device being a tie strap.

6. The illuminated hard hat of claim 1, wherein the lighting strips having one or more lights.

7. The illuminated hard hat of claim 6, wherein the lights being light emitting diode (LED) lamps.

8. The illuminated hard hat of claim 6, wherein the lights having a number being three (3).

9. The illuminated hard hat of claim 1, wherein when the switch being actuated, the lighting strips emitting an illumination.

10. The illuminated hard hat of claim 1, wherein when the switch being actuated a second time, the illumination of the lighting strip being disabled.

11. An illuminated hard hat 100 for providing visibility to workers, the illuminated hard hat consisting of:

a hard hat, the hard hat having a back, an interior and an adjusting control;

a suspension band, the suspension band comprising:

a base band, the base band having an outside;

a plurality of straps, the plurality of straps having an outside, wherein the straps being coupled to the base band;

a plurality of lighting strips, each of the lighting strips being removably coupled to the outside of one of the straps by a fastener, wherein the fastener being a hook and loop fastening device, wherein the lighting strips having one or more lights, wherein the lights being light emitting diode (LED) lamps, wherein the lights are three in number;

a power source, the power source being coupled to the outside of the base band, wherein the power source being a rechargeable battery;

a switch, the switch being electrically coupled to the outside of the base band, wherein the switch being a push button switch, wherein when the switch being actuated, the lighting strips emitting an illumination, and wherein when the switch being actuated a second time, the illumination of the lighting strip being disabled; and the adjusting control, the adjusting control being coupled to the back of the hard hat, wherein the adjusting control being electrically coupled to the switch, and wherein the adjusting control being electrically coupled to the lighting strips, wherein the adjusting control being a dial control, and wherein the suspension band being coupled to the interior of the hard hat, and wherein the hard hat complies with OSHA requirements.

* * * * *